US009670796B2

(12) United States Patent
Scipio et al.

(10) Patent No.: US 9,670,796 B2
(45) Date of Patent: Jun. 6, 2017

(54) COMPRESSOR BELLMOUTH WITH A WASH DOOR

(71) Applicant: General Electric Company, Schenectady, NY (US)

(72) Inventors: Alston Ilford Scipio, Atlanta, GA (US); Sanji Ekanayake, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 1153 days.

(21) Appl. No.: 13/670,520

(22) Filed: Nov. 7, 2012

(65) Prior Publication Data

US 2014/0126998 A1 May 8, 2014

(51) Int. Cl.

| | |
|---|---|
| ***F01D 25/00*** | (2006.01) |
| ***B08B 3/02*** | (2006.01) |
| ***B05B 7/08*** | (2006.01) |

(52) U.S. Cl.

CPC ..... *F01D 25/002* (2013.01); *B05B 7/0892* (2013.01); *B08B 3/02* (2013.01)

(58) Field of Classification Search

CPC ..... F01D 25/002; B05B 7/0892; B08B 3/02
See application file for complete search history.

(56) References Cited

U.S. PATENT DOCUMENTS

| | | | | |
|---|---|---|---|---|
| 6,050,079 | A | 4/2000 | Durgin et al. | |
| 6,385,958 | B2 | 5/2002 | Leone et al. | |
| 6,393,825 | B1 | 5/2002 | Leone et al. | |
| 6,478,033 | B1 * | 11/2002 | Foster | C11D 3/0073 134/22.1 |
| 6,615,574 | B1 * | 9/2003 | Marks | F02C 7/18 60/772 |
| 6,630,198 | B2 | 10/2003 | Ackerman et al. | |
| 6,644,935 | B2 | 11/2003 | Ingistov et al. | |
| 6,657,715 | B2 | 12/2003 | Vaez-Iravani et al. | |
| 6,659,715 | B2 | 12/2003 | Kuesters et al. | |
| 6,786,635 | B2 | 9/2004 | Choi | |
| 6,796,709 | B2 | 9/2004 | Choi | |
| 7,243,042 | B2 | 7/2007 | Plotts et al. | |
| 7,548,830 | B2 | 6/2009 | Goebel et al. | |
| 8,096,747 | B2 | 1/2012 | Sengar et al. | |
| 8,268,134 | B2 | 9/2012 | Goller et al. | |
| 2002/0141882 | A1 | 10/2002 | Ingistov et al. | |
| 2004/0026261 | A1 | 2/2004 | Stoffer et al. | |

(Continued)

FOREIGN PATENT DOCUMENTS

| | | | |
|---|---|---|---|
| EP | 0674024 | B1 | 12/1998 |
| EP | 1903188 | A2 | 3/2008 |
| GB | 796269 | A | 6/1958 |

OTHER PUBLICATIONS

U.S. Appl. No. 13/303,852, filed Nov. 23, 2011, Scipio, et al.

(Continued)

*Primary Examiner* — Nathaniel Wiehe
(74) *Attorney, Agent, or Firm* — Eversheds Sutherland (US) LLP

(57) ABSTRACT

The present application thus provides a compressor wash system for use about a bellmouth of a compressor of a gas turbine engine. The compressor wash system may include a bellmouth wash nozzle positioned about the bellmouth of the compressor and a wash door assembly positioned about a lower half of the bellmouth such that the wash door assembly may be closed when the bellmouth wash nozzle is activated.

15 Claims, 3 Drawing Sheets

(56) References Cited

U.S. PATENT DOCUMENTS

| | | | | |
|---|---|---|---|---|
| 2004/0073400 | A1 | 4/2004 | Tomita et al. | |
| 2007/0000528 | A1* | 1/2007 | Asplund | B08B 3/02 134/166 R |
| 2007/0048127 | A1 | 3/2007 | O'Neill et al. | |
| 2007/0059159 | A1* | 3/2007 | Hjerpe | B08B 3/02 415/117 |
| 2007/0137213 | A1 | 6/2007 | Rickert et al. | |
| 2009/0158739 | A1 | 6/2009 | Messmer | |
| 2010/0080685 | A1 | 4/2010 | Morgan et al. | |
| 2012/0083933 | A1 | 4/2012 | Subbu et al. | |
| 2012/0134777 | A1 | 5/2012 | Eleftheriou et al. | |
| 2012/0145187 | A1 | 6/2012 | Abe et al. | |
| 2012/0251742 | A1 | 10/2012 | Kerber | |
| 2013/0047580 | A1* | 2/2013 | Beardsley | B64D 29/06 60/226.2 |

OTHER PUBLICATIONS

U.S. Appl. No. 13/485,160, filed May 31, 2012, Ekanayake, et al.
U.S. Appl. No. 13/485,273, filed May 31, 2012, Ekanayke, et al.
U.S. Appl. No. 13/347,358, filed Jan. 10, 2012, Chillar, et al.
U.S. Appl. No. 13/492,333, filed Jun. 8, 2012, Scipio.

* cited by examiner

COMPRESSOR BELLMOUTH WITH A WASH DOOR

TECHNICAL FIELD

The present application and the resultant patent relate generally to gas turbine engines and more particularly relate to offline compressor wash systems and methods using a bellmouth with a pivoting wash door for improved compressor washing and coating.

BACKGROUND OF THE INVENTION

As a gas turbine engine operates, airborne contaminants may coat the blades and the vanes of the compressor and other components. Over time, particulate accumulation may restrict the airflow through the compressor and may adversely impact on the overall gas turbine engine performance and efficiency. In order to reduce such accumulation, water wash systems may be used to remove the accumulated particulate matter from the compressor blades and vanes.

Although such water wash systems may be effective in cleaning early compressor stages, the middle and later compressor stages often show reduced cleaning or relatively little cleaning at all. Specifically, the cleaning solution is generally injected about a bellmouth at the front end of the compressor. The cleaning solution may be degraded or vaporized by the time the later stages are reached. Moreover, the nozzles for the cleaning solution may become plugged so as to reduce further the cleaning effectiveness as well as producing undesirable variations in the spray patterns. Other known methods for cleaning compressors include increasing the duration and/or frequency of the washes, increasing the ratio of the cleaning solution to water, changing the type of cleaning solution, use of foam-based cleaning agents, and/or performing periodic manual cleaning.

There is thus a desire for improved offline compressor wash systems and methods. Preferably, such improved systems and methods may adequately wash all of the compressor stages, particularly the later compressor stages, so as to provide improved performance and efficiency.

SUMMARY OF THE INVENTION

The present application and the resultant patent thus provide a compressor wash system for use about a bellmouth of a compressor of a gas turbine engine. The compressor wash system may include a bellmouth wash nozzle positioned about the bellmouth of the compressor and a wash door assembly positioned about a lower half of the bellmouth such that the wash door assembly may be closed when the bellmouth wash nozzle is activated.

The present application and the resultant patent further provide a method of washing a compressor. The method may include the steps of injecting a cleaning solution through a bellmouth wash nozzle, closing a wash door positioned about a bellmouth of the compressor, and rotating the compressor at a predetermined speed with the cleaning solution therein.

The present application and the resultant patent further provide a compressor for use with a gas turbine engine. The compressor may include a bellmouth, a number of stages downstream of the bellmouth, and a compressor wash system. The compressor wash system may include a wash nozzle and a wash door assembly positioned about the bellmouth.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
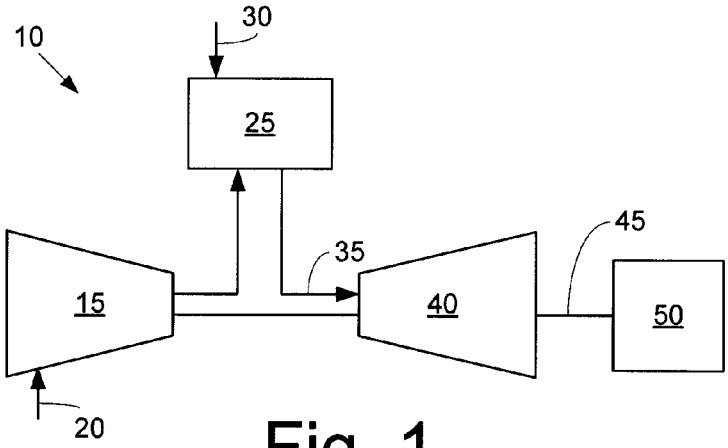
FIG. 1 is a schematic diagram of a gas turbine engine showing a compressor, a combustor, a turbine, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
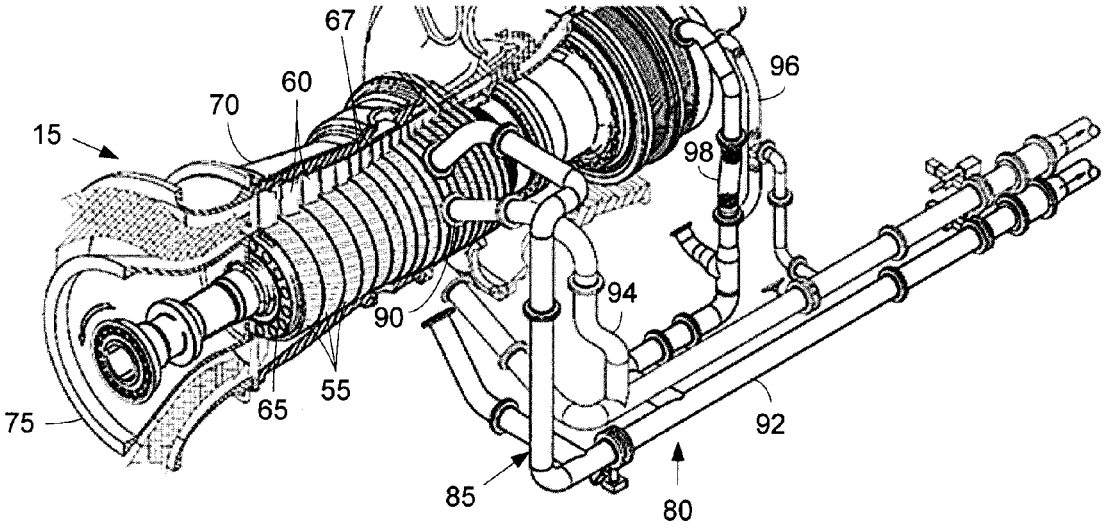
FIG. 2 is a partial sectional view of a compressor with compressor extraction piping.

FIG. 2 is an example of a compressor 15 as may be used with the gas turbine engine 10 and the like. The compressor 15 may include a number of stages 55. Although eighteen stages 55 are shown, any number of the stages 55 may be used. Each stage 55 includes a number of circumferentially arranged rotating blades 60. Any number of the blades 60 may be used. The blades 60 may be mounted onto a rotor wheel 65. The rotor wheel 65 may be attached to the shaft 45 for rotation therewith. Each stage 55 also may include a number of circumferentially arranged stationary vanes 67. Any number of the vanes 67 may be used. The vanes 67 may be mounted within an outer casing 70. The casing 70 may extend from a bellmouth 75 towards the turbine 40. The flow of air 20 thus enters the compressor 15 about the bellmouth 75 and is compressed through the blades 60 and the vanes 67 of the stages 55 before flowing to the combustor 25.

The gas turbine engine 10 also may include an air extraction system 80. The air extraction system 80 may extract a portion of the flow of air 20 in the compressor 15 for use in cooling the turbine 40 and for other purposes. The air extraction system 80 may include a number of air extraction pipes 85. Each air extraction pipe 85 may extend from an extraction port 90 about one of the compressor stages 55 towards one of the stages of the turbine 40. In this example, a ninth stage extraction pipe 92 and a thirteenth stage extraction pipe 94 may be shown. Extractions from other stages 55 of the compressor 15 also may be used. The ninth stage extraction pipe 92 may be in communication with a third stage 96 of the turbine 40 while the thirteen stage extraction pipe 94 may be in communication with a second stage 98 of the turbine. Other turbine stages and other types of extractions may be used.

Figure 3:
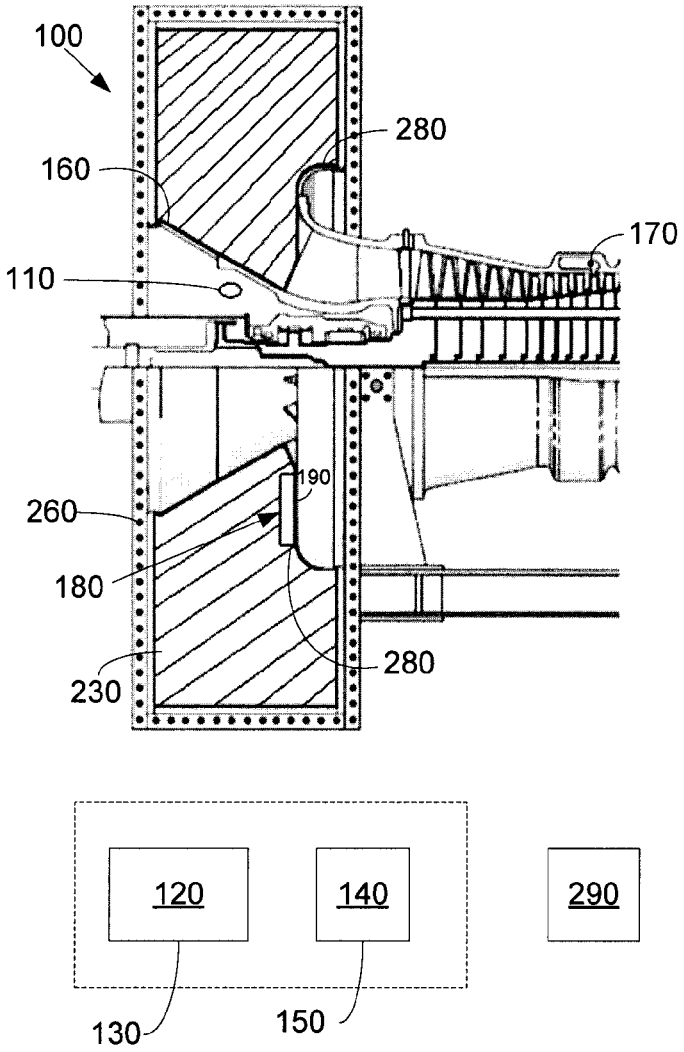
FIG. 3 is a partial sectional view of a compressor wash system with a bellmouth door as may be described herein.
Figure 4:
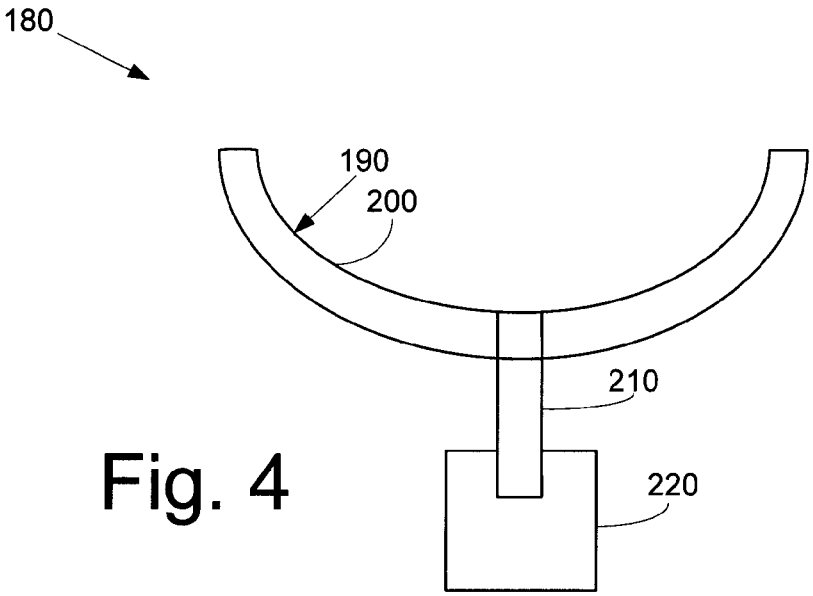
FIG. 4 is a front view of the bellmouth door of the compressor wash system of FIG. 3.
Figure 5:
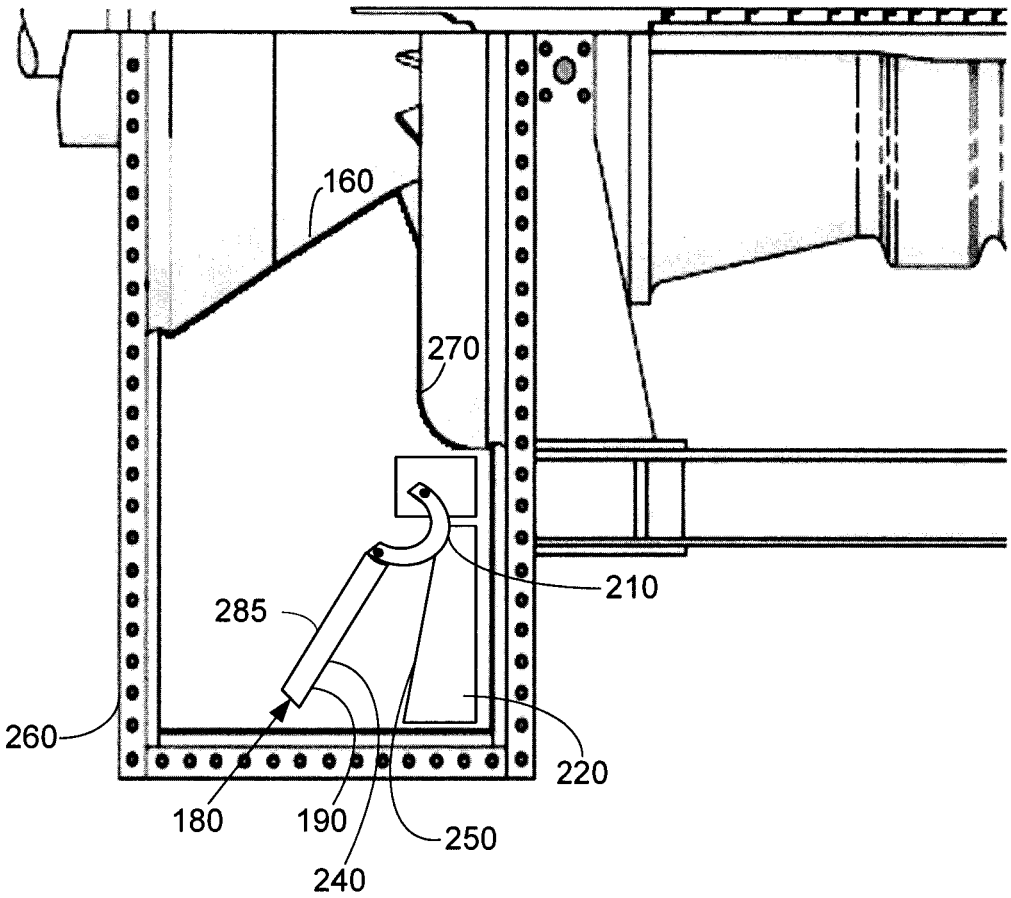
FIG. 5 is a partial side view of the compressor wash system with the bellmouth door of FIG. 3.

FIGS. 3-5 show an example of a compressor wash system 100 as may be described herein. The compressor wash system 100 may include one or more bellmouth wash nozzles 110. The bellmouth wash nozzles 110 may have any suitable size, shape, or configuration. The bellmouth wash nozzles 110 may be in communication with a water source 120 with a volume of water 130 therein as well as a detergent source 140 with a volume of a detergent 150 therein. The water 130 and the detergent 150 may be combined in a predetermined ratio to provide a cleaning solution 155. Other types of fluids and other types of fluid sources may be used herein. One or more of the bellmouth wash nozzles 110 may be positioned about an inner casing 160 of the bellmouth 75 such that the flow of the cleaning solution 155 follows a generally axial path through the stages 55 of the compressor 15. Other components and other configurations also may be used herein.

The compressor wash system 100 also may include a number of downstream wash nozzles 170. The downstream wash nozzles 170 may have any suitable size, shape, or configuration. One or more of the downstream wash nozzles 170 may be positioned about the later stages 55 of the compressor 15. Specifically, one or more of the downstream wash nozzles 170 may be in communication with the ninth stage extraction pipe 92 and one or more of the downstream wash nozzles 170 may be in communication with the thirteenth stage extraction pipe 94. Other stages may be used herein. The ninth stage extraction pipe 92 and the thirteenth stage extraction pipe 94 may be in communication with the water source 120 and the detergent source 140 for the flow of the cleaning solution 155. Other components and other configurations also may be used herein.

The compressor wash system 100 also may have a wash door assembly 180 as may be described herein positioned about the bellmouth 75. The wash door assembly 180 may include a wash door 190. As is shown in, for example, FIG. 4, the wash door 190 may have a substantially half circle-like shape or a substantially "U"-like shape 200. The shape of the wash door 190 largely conforms to the shape of the bellmouth. The wash door assembly 180 may include a hinge 210. The hinge 210 may extend between the wash door 190 and an actuation device 220. Other types of pivoting devices may be used herein. The actuation device 220 may include an electric motor, a pneumatic device, and the like so as to pivot the wash door 190 between a closed position 230 as is shown in FIG. 3 and an opened position 240 as is shown FIG. 5. The wash door assembly 180 also may include a spring 250. The spring 250 may bias the wash door 190 in the open position 240. Other components and other configurations may be used herein.

The wash door 190 may be positioned about a lower half 260 of the bellmouth 75. The wash door 190 may be positioned about a forward casing 270 of the compressor 15 so as to block the flow path therethrough when closed. The wash door 190 may extend between the bellmouth inner casing 160 and an outer casing 280. The door 190 may have a rubberized contact sealing surface 285 to positively engage with the forward casing 270. A number of limit switches and other types of sensors may be used to ensure a positive engagement. Other components and other configurations may be used herein.

The compressor wash system 100 may be operated by a wash controller 290. The wash controller 290 may provide the water 130 and the detergent 150 to the bellmouth wash nozzles 110 and the downstream wash nozzles 170 in the appropriate ratios thereof for the wash solution 155. The wash controller 290 may be any type of programmable logic controller and may be in communication with the overall control system of the gas turbine engine 10. The wash controller 290 also may control the wash door assembly 180 so as to pivot the wash door 190 between the closed position 230 and the open position 240 by the actuation device 220. Various types of sensors may be used herein to provide feedback to the wash controller 290. Access to the wash controller 290 and the operational parameters herein may be restricted to ensure adequate cleaning and coverage.

The wash controller 290 also may determine that the overall operational parameters are appropriate for the use of the compressor wash system 100. Specifically, the wash controller 290 may determine that the turbine 40 is operating at "turning gear" speed to facilitate the cleaning action of the cleaning solution 155. Further, the wash controller 290 may determine that the wheel space temperature is at the appropriate level such that the injection of the cleaning solution 155 will not thermally shock the internal metal so as to induce creep or induce any mechanical or structural deformation in the material. Moreover, the wash controller 290 also may automatically open the wash door 190 if shaft speeds exceeds a predetermined RPM limit and the like. Other types of operational parameters may be considered herein.

Once the operational prerequisites have been met, the wash controller 290 may engage the compressor wash system 100. The wash controller 290 thus may move the door wash 190 into the closed position 230 via the actuation device 220. The cleaning solution 155 then may be injected into the compressor 15 via the bellmouth wash nozzles 110 and/or the downstream wash nozzles 170. The cleaning solution 155 may fill the casing 70 of compressor 15 to a predetermined level and/or volume so as to facilitate a predetermined contact time between the compressor components and the cleaning solution 155. The compressor wash system 100 thus permits a prewash soaking of the components therein so as to remove deposits from the compressor blades and vanes as well as to treat the metal surfaces thereof. For example, an anti-static solution and the like may be used herein. The wash controller 290 may turn off the bellmouth wash nozzles 110 and/or the downstream wash nozzles 170 and open the wash door 190 after a predetermined volume, a predetermined time, or other parameter. Other components and other configurations may be used herein.

The compressor wash system 100 thus provides adequate and thorough cleaning of the compressor 15 and particularly the later stages 55 thereof. Moreover, the compressor wash system 100 may eliminate or reduce issues with the nozzles being plugged and impacting upon the spray pattern. The compressor wash system 100 may substantially reduce output and heat rate degradation rates by permitting the addition of various solvents without using the traditional nozzles. The compressor wash system 100 may be easy to install without requiring new casing penetrations and may be easily integrated into existing control systems. The compressor wash system 100 may provide a reduction in compressor blade erosion from numerous water washes. Specifically, the compressor wash system 100 may provide higher quality washes in less time as well as an increase in the percentage of good washes overall. Different types of cleaning solutions may be used herein. Moreover, similar or different cleaning solutions may be used for the compressor 15 and the turbine 40.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A compressor wash system for use about a bellmouth positioned at a forward casing of a compressor of a gas turbine engine, comprising:

a bellmouth wash nozzle positioned about the bellmouth of the compressor; and a wash door assembly positioned about a lower half of the bellmouth such that the wash door assembly may be closed when the bellmouth wash nozzle is activated, the wash door assembly comprising a wash door coupled to an actuation device, wherein the actuation device is coupled to an outer casing of the compressor, and the wash door is configured to pivot from a closed position to an open position; and wherein the wash door is in contact with the forward casing of the compressor in the closed position.

2. The compressor wash system of claim 1, wherein the bellmouth wash nozzle is in communication with a water source and a detergent source.

3. The compressor wash system of claim 1, wherein the bellmouth wash nozzle is positioned about an inner casing of the bellmouth.

4. The compressor wash system of claim 1, further comprising a plurality of bellmouth wash nozzles.

5. The compressor wash system of claim 1, further comprising one or more downstream wash nozzles positioned about one or more stages of the compressor.

6. The compressor wash system of claim 5, wherein the one or more downstream wash nozzles are in communication with one or more air extraction pipes.

7. The compressor wash system of claim 1, wherein the wash door has a "U"-like shape.

8. The compressor wash system of claim 7, wherein the wash door extends between an inner casing and the outer casing of the bellmouth.

9. The compressor wash system of claim 7, wherein the wash door comprises a rubberized contact surface thereon.

10. The compressor wash system of claim 1, wherein the wash door assembly comprises a spring coupled to the actuation device and the wash door to move the wash door from the opened position to the closed position.

11. The compressor wash system of claim 1, wherein the wash door assembly comprises a spring coupled to the actuation device to bias a wash door in an open position.

12. The compressor wash system of claim 1, further comprising a wash controller in communication with the bellmouth wash nozzle and the wash door assembly.

13. The compressor wash system of claim 1, wherein the wash door is biased in the open position with a spring.

14. The compressor wash system of claim 1, wherein the wash door is substantially planar.

15. A compressor for use about a forward casing of a gas turbine engine, comprising:

a bellmouth;

a plurality of stages downstream of the bellmouth; and a compressor wash system;

the compressor wash system comprising a wash nozzle and a wash door assembly positioned about the bellmouth, the wash door assembly comprising a wash door coupled to an actuation device, wherein the actuation device is coupled to an outer casing of the compressor, and the wash door is configured to pivot from a closed position to an open position; and wherein the wash door is in contact with the forward casing of the compressor in the closed position.

* * * * *